United States Patent [19]

Flick

[11] Patent Number: 4,606,134

[45] Date of Patent: Aug. 19, 1986

[54] DISPOSABLE STRIKING LINE DISPENSER

[76] Inventor: Robert A. Flick, 2401 County Barn Rd., Naples, Fla. 33962

[21] Appl. No.: 794,839

[22] Filed: Nov. 4, 1985

[51] Int. Cl.[4] ..... B44D 3/38; B26D 7/00

[52] U.S. Cl. ..... 33/414; 83/649; 206/409

[58] Field of Search ..... 33/413, 414; 83/649, 83/909; 206/409, 603; 225/39, 40, 41, 46, 49, 50, 61

[56] References Cited

U.S. PATENT DOCUMENTS

| | | | |
|---|---|---|---|
| 439,622 | 11/1890 | Bastin | 206/409 |
| 680,557 | 8/1901 | Wilson | 33/414 |
| 2,725,244 | 11/1955 | Friday | 225/41 |
| 3,046,663 | 7/1962 | Romero | 33/414 |
| 3,099,091 | 7/1963 | Hindall | 33/414 |
| 3,246,814 | 4/1966 | Lovell et al. | 206/603 |
| 3,696,697 | 10/1972 | Hoffman | 83/649 |
| 4,566,606 | 1/1986 | Kling | 206/409 |

*Primary Examiner*—Richard R. Stearns
*Attorney, Agent, or Firm*—Merrill N. Johnson

[57] ABSTRACT

A dispenser for pre-inked disposable striking lines consisting of an open-topped plastic case, an air-tight cover sealing the open top of said case, an axle within said case for rotatable support of a continuous spool of pre-inked line, an annular gasket mounted on said cover surrounding the line as it exits from said case, a knife-edged cutter mounted on the cover for cutting off a desired length of inked line, the cover having a clear plastic window for viewing the remaining amount of line on the spool, and a lid hingedly mounted on the top of the case.

4 Claims, 3 Drawing Figures

DISPOSABLE STRIKING LINE DISPENSER

BACKGROUND AND SUMMARY OF THE INVENTION

The invention relates to a dispenser for pre-inked disposable striking lines to be used by carpenters, bricklayers, paperhangers and other workers in marking straight lines on various surfaces.

In the past, most lines used to strike or mark a straight line have been lines loaded with dry powdered chalk and these lines are retractable into a closed container filled with powdered chalk. But powdered chalk as a marking agent has its disadvantages, especially in areas of high humidity.

If the striking line is retracted into the container while wet or moist, the powdered chalk will become caked and will not deposit evenly onto the line. During periods of high humidity, the powdered chalk inside the container will tend to cake, making the line unworkable, and on windy days the chalk can be blown off the line, making it unworkable. Moreover, chalk lines must be constantly retracted and re-chalked after each use, which takes valuable time by the worker involved.

An object of my invention is a striking line having a uniform deposit of liquid marking agent which does not blow off in the wind and which can be economically disposed after use, thus eliminating the need to retract the line into a container.

A further object of my invention provides a striking line dispenser made of molded plastic material containing a spool of ink-soaked line, an air-tight cover for the container, an annular gasket surrounding the line as it exits from the container, a knife-edged cutter for the line mounted on the cover of the container, and a clear plastic window in the cover to observe the amount of line remaining on the spool.

Preferably my invention includes a sealable throw-away molded plastic dispenser having an open top, a molded plastic cover including an axle which rotatably supports a spool of ink-soaked striking line within the dispenser, and a gasket tightly sealing the cover into the open top of the dispenser. A second annular gasket in the cover closely surrounds the line as it exits from the sealed dispenser to prevent evaporation of the ink within the dispenser. The cover also contains a metal cutter for cutting the line and a clear plastic window for observing the line remaining on the spool. The dispenser also includes a hinged plastic lid which fits over the cover to protect the exposed end of the line and the cutter when not in use.

DETAILED DESCRIPTION OF THE PREFERRED EMBODIMENT

Figure 1:
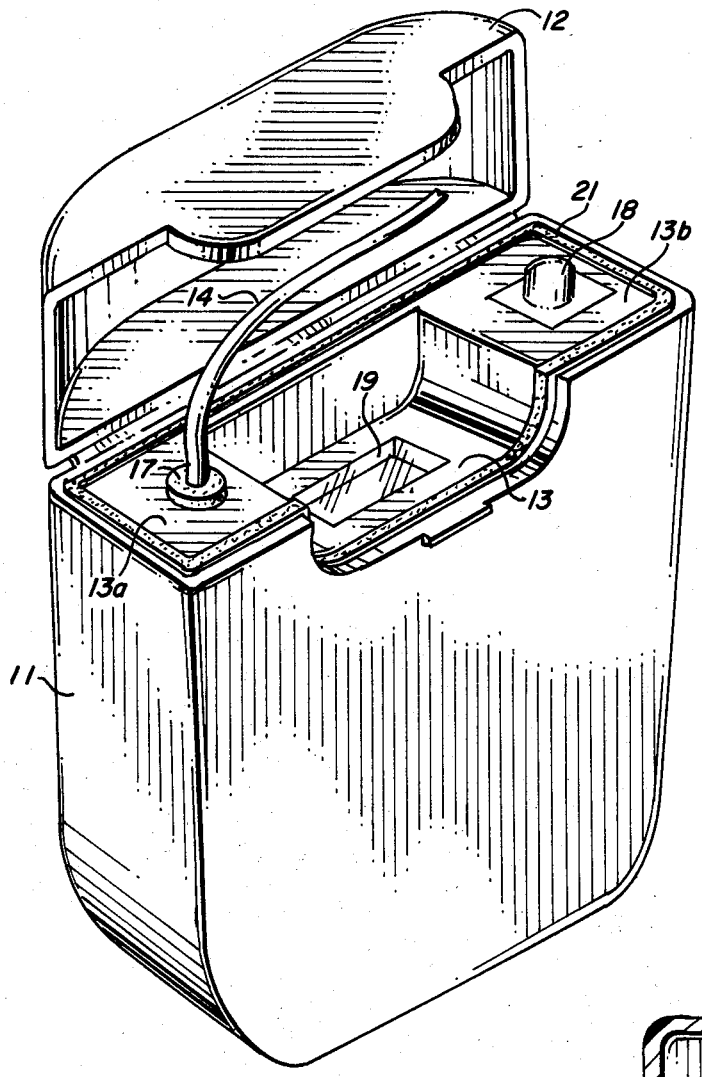
FIG. 1 is a perspective view of the line dispenser with its lid open, showing the line exiting from the dispenser and the window and cutter on the dispenser's cover.
Figure 2:
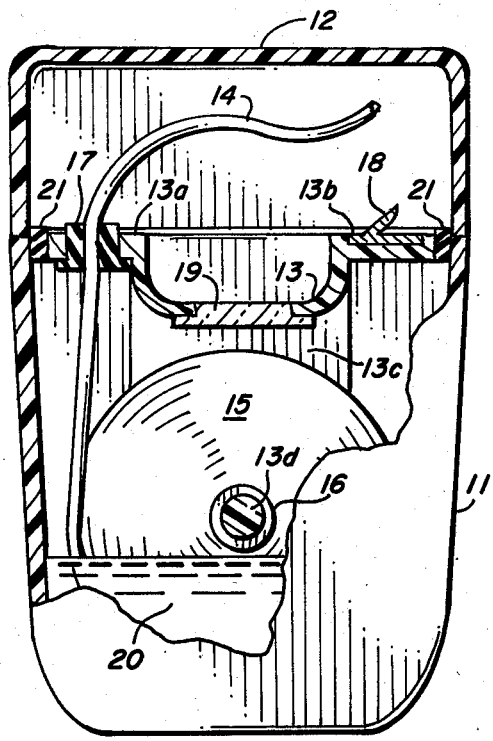
FIG. 2 is a partially broken away cross-sectional side view of the dispenser.

Referring to FIGS. 1 and 2 of the drawings, the line dispenser includes an open-topped case 11 and a hinged lid 12 made as a single molded assembly of nylon or other suitable thermoplastic material. Sealing the top of case 11 is a cover 13 having two plane surfaces **13*a* and 13*b* and a vertically extending flange 13*c* from which projects a horizontally extending axle 13*d***.

Gasket 21 provides an air-tight seal between the top of case 11 and cover 13. Axle **13*d* rotatably supports a spool 15 of striking line 14 wound on a cylindrical hub 16. Before being mounted on axle 13*b*, the spool 15 of line is pre-soaked in a colored ink or similar liquid marking agent, which may be either washable or permanent ink. Depending upon the characteristics of the liquid marking agent in which spool 15 is soaked prior to its insertion into case 11, it may be desirable to pour a small quantity of marking agent 20 as shown in FIG. 2 into case 11 to assure that the line retain marking agent during storage and prior to use. Cover 13 and spool 15 are inserted into case 11 and sealed in place by a gasket 21** or other suitable sealing means.

Line 14 is preferably made of cotton, linen or synthetic fibers twisted or spun into a continuous thread preferably having a diameter of 1/32 of an inch more or less. The line is wound onto a cylindrical hub 16 into a spool 15 providing 100 to 200 or more yards of disposable striking line 14. The outer end of line 14 exits from the interior of case 11 by passing through the center of an annular gasket 17 made of resilient material and sized to gently grip line 14 to inhibit air passage into or out of the interior of the case 11, thus preventing evaporation of marking liquid from the spool of line.

Figure 3:
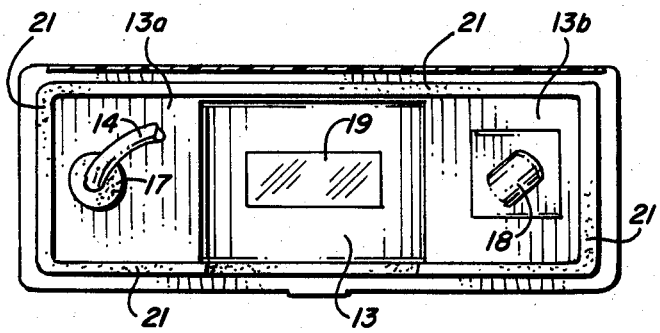
FIG. 3 is a plan view of the dispenser with the lid removed, showing the cover and its gaskets, window and cutter.

As best shown in FIG. 3, annular gasket 17 is mounted in a hole in cover surface **13*a* while a knife-edged metal cutter 18 is mounted on cover surface 13*b* to provide a convenient means for severing a suitable length of inked striking line when desired. In order for the user of the dispenser to determine the amount of line remaining on spool 15, a clear plastic window 19 is provided in cover 13. When the line dispenser is not in use, lid 12 is closed as shown in FIG. 2 over cover 13 to protect the exposed end of line 14 and cutter 18**.

To use, lid 12 is opened as shown in FIG. 1 and the end of line 14 is grasped and pulled out to the desired length of the line to be marked. One person holds the dispenser at one end of the line to be marked while a second person holds the end of line 14 tightly at the other end of the line to be marked. When the striking line is tightly stretched along the line to be marked, one or the other of the persons holding the line reaches toward the center of the stretched line and lifts the line away from the surface to be marked and releases the line, causing the line to "snap" against the surface to be marked and liquid marking agent from the line to be transferred to the surface as a clearly visible straight line.

There may be sufficient liquid marking agent remaining on the line to permit a given length of line to be used to mark more than a single line upon a surface. And in any event, when the length of line 14 has been used for its intended purpose, the used line is simply severed from the remaining line on spool 15 by use of cutter 18 and discarded. The use of my dispenser saves the time required with conventional striking lines of constantly having to wind the used line back into its container to be stored and re-chalked.

And, of course, when the line within the dispenser has been exhausted, the empty case 11 is thrown away and a new dispenser is put into use.

Various changes may be made in the preferred embodiment of my invention as shown and described without departing from the spirit and scope of my invention as set forth in the following claims.

I claim:

1. A dispenser for pre-inked disposable striking lines comprising an open-topped case made of thermoplastic material, a cover sealing the open top of the case, said cover including a hole, a clear plastic window and a knifeedged metal cutter mounted on said cover, an axle mounted within said case, a hub rotatably mounted on said axle, a spool of pre-inked striking line mounted on said hub with the end of said line exiting from said case through the hole in the cover, and an annular flexible gasket mounted on said cover and surrounding the line exiting from the case.

2. A dispenser as set forth in claim 1 which includes a lid hingedly connected to said case which when closed protects the exposed end of the striking line and the cutter.

3. A dispenser as set forth in claim 1 which includes a quantity of liquid marking agent within the case.

4. A dispenser for pre-inked striking lines comprising an assembly consisting of an open-topped case and a hingedly connected lid made of thermoplastic material, a cover for sealing the open top of said case, said cover made of thermoplastic material and including two spaced-apart flat planar surfaces and a downwardly extending flange from which projects an axle, a rotatable hub mounted on said axle and containing a spool of striking line which has been previously soaked in a liquid marking agent, a hole in one of the planar surfaces of said cover, an annular gasket mounted in said hole with the end of the spool of striking line exiting from said case passing through the center of said gasket, and a knife-edged metal cutter mounted on the second planar surface of said cover.

* * * * *